United States Patent [19]

Cook

[11] Patent Number: 4,606,307

[45] Date of Patent: Aug. 19, 1986

[54] AUTOMATIC STARTING SYSTEM

[76] Inventor: Norman E. Cook, 9025 Broken Arrow Rd., Indianapolis, Ind. 46234

[21] Appl. No.: 556,989

[22] Filed: Dec. 1, 1983

[51] Int. Cl.[4] ..... F02N 11/08

[52] U.S. Cl. ..... 123/179 B; 123/179 G; 290/38 E

[58] Field of Search ..... 123/179 B, 179 BG, 179 G; 290/38 C, DIG. 3, 38 E

[56] References Cited

U.S. PATENT DOCUMENTS

| | | | |
|---|---|---|---|
| 2,698,391 | 12/1954 | Braden et al. | 290/2 |
| 2,748,759 | 6/1956 | Schiffer | 123/179 |
| 2,836,732 | 5/1958 | Newlin | 290/38 |
| 2,975,296 | 3/1961 | Dominguez-Rego | 290/37 |
| 3,530,846 | 9/1970 | Bean et al. | 123/179 BG |
| 3,538,898 | 11/1970 | Egdemir | 123/179 BG |
| 3,696,333 | 10/1972 | Mott | 340/52 R |
| 3,859,540 | 1/1975 | Weiner | 123/179 BG |
| 4,080,537 | 3/1978 | Bucher | 123/179 B |
| 4,200,080 | 4/1980 | Cook et al. | 123/179 BG |
| 4,236,594 | 12/1980 | Ramsperger | 290/38 E |
| 4,345,554 | 8/1982 | Hildreth et al. | 123/179 BG |
| 4,392,059 | 7/1983 | Nespor | 123/179 BG |

*Primary Examiner*—Andrew M. Dolinar

*Attorney, Agent, or Firm*—Woodard, Weikart, Emhardt & Naughton

[57] ABSTRACT

An automatic starting system for a vehicle includes a starter circuit, a battery and an internal combustion engine with a throttle-gas pedal linkage. The starting system includes a clock and remote-control receiver and transmitter combination which are electrically connected to the battery and operable to be energized for selectively connecting a current signal from the battery to the balance of the system. An arrangement of timer circuits is provided and suitably arranged for electrically coupling the current signal from the system energizing means to the starter circuit of the vehicle. An actuator and vacuum pump combination enables the throttle-gas pedal linkage to be pumped when such pumping is the required or appropriate as a part of the recommended method to start the vehicle engine. The system includes an arrangement of timers for alternately energizing and deenergizing the gas pedal pumping arrangement and these timers are cooperatively arranged, one with respect to the other, such that one timer cycles on and off within the time-on interval of a second connected timer. Still further timers of the system are responsive to the time interval that the vehicle engine has been off in order to determine whether or not pumping action needs to occur before cranking, or one pump during cranking when the engine is restarted. Switches for selecting the number of pumping actions required depending on the vehicle and the number of cylinders of the vehicle are provided for individually tailoring the disclosed system to the vehicle.

39 Claims, 5 Drawing Figures

AUTOMATIC STARTING SYSTEM

BACKGROUND OF THE INVENTION

This invention relates in general to electronic devices and in particular to such devices arranged as an automatic starting system for vehicles.

Automatic starting systems for vehicles represent an attempt by man to simplify a manual activity by the use of electronics. The object quite simply is to enable an individual to start a vehicle either by clock means at a preselected time of day and/or from a remote location at any desired time by the use of remote control transmitter-receiver means. The following listed patents disclose certain circuit arrangements which have been conceived in an attempt to provide improvements to automatic starting systems.

| Patent No. | Patentee |
|---|---|
| 2,698,391 | Braden et al. |
| 2,748,759 | Schiffer |
| 2,836,732 | Newlin |
| 2,975,296 | Dominguez-Rego |
| 3,696,333 | Mott |

Braden et al. discloses an engine-control system whereby an engine may be started and stopped automatically under the control of a clock mechanism. Also provided are means to start and stop the engine under certain temperature conditions.

Schiffer discloses an automatic starting device for an internal combustion engine which incorporates a timing mechanism for starting a car at a speed somewhat above idling speed and reducing the speed to the correct idling speed when the proper vehicle temperature is reached.

Newlin discloses an automatic car starter for automatically starting a motor vehicle at a predetermined time and energizing the motor vehicle heater at the predetermined time, whereby the automobile engine and the interior of the automobile will have had sufficient time to warm up when the operator enters the vehicle.

Dominguez-Rego discloses a clock-control circuit for energizing the ignition circuit of a vehicle, the starter and the heater and for controlling the throttle opening during the starting and warm-up periods. The circuit deenergizes the starter once the engine has started and restarts the engine if it stalls while warming up or idling.

Mott discloses an automatic automobile starter which permits utilization of either a clock-switching mechanism or a radio remote control switching system to supply current to the starter motor. Current is supplied to the ignition coil through an oil pressure switch to insure that the engine will not start unless there is sufficient oil pressure.

None of these disclosed devices or systems disclose means by which the gas pedal may be pumped prior to current being coupled to the starter which is the vehicle manufacturer's recommended way to start most vehicles which have a cold engine. In addition, none of the disclosed devices or systems include sufficient safety features to virtually eliminate any type of damage to the vehicle or injury to others. For example, if an overspeed condition would result, such as by a child playing with the gas pedal of the started and still-unattended vehicle, there are no disclosed means to turn off the engine automatically. Similarly, if a child would attempt to raise the hood when the vehicle is being, or has already been, remotely started, then without some type of interlock switch to turn off the engine, the child could be injured. Furthermore, none of the disclosed devices or systems provide means for remote-control turn-off of the vehicle once it has been started.

While the foregoing deficiencies or drawbacks to the listed prior references were overcome by my U.S. Pat. No. 4,200,080, which issued Apr. 29, 1980, improvements are still possible as evidenced by the present invention. My prior patent would likely not be considered a total solid-state system, and the mere exchanges of parts would likely not result in the creation of an invention. However, the present invention has gone far beyond the mere exchanging of parts. Although parts have been replaced and the new design is predominantly solid state, key changes have been made to the starting procedure of the vehicle engine depending upon the time periods that the engine has been running and/or not running, rather than relying on the engine temperature as was the approach in U.S. Pat. No. 4,200,080. While this running or not-running time period approach is clearly a departure from and an improvement over my prior patent, it is also novel an unobvious over any of the prior listed references.

SUMMARY OF THE INVENTION

An automatic starting system for a vehicle which includes the starter circuit, battery and an internal combustion engine with a throttle-gas pedal linkage, according to a typical embodiment of the present invention includes system energizing means which are electrically connectable to the battery of the vehicle, the system energizing means being selectively actuatable for conducting a current signal from the battery, a plurality of switch means designed and arranged and electrically operable to couple a current signal from the system energizing means to the starter circuit of the vehicle, gas pedal pumping means connectable to the throttle-gas pedal linkage of the vehicle and means for alternately energizing and deenergizing the gas pedal pumping means for finite time interval, thereby creating a pumping action of the throttle-gas pedal linkage, the energizing and deenergizing means including a plurality of timers with different time out intervals whereby one timer cycles on and off within the time-on interval of the second connected timer.

One object of the present invention is to provide an improved automatic starting system for a vehicle.

Related objects and advantages of the present invention will be apparent from the following description.

DESCRIPTION OF THE PREFERRED EMBODIMENT

Figure 1:
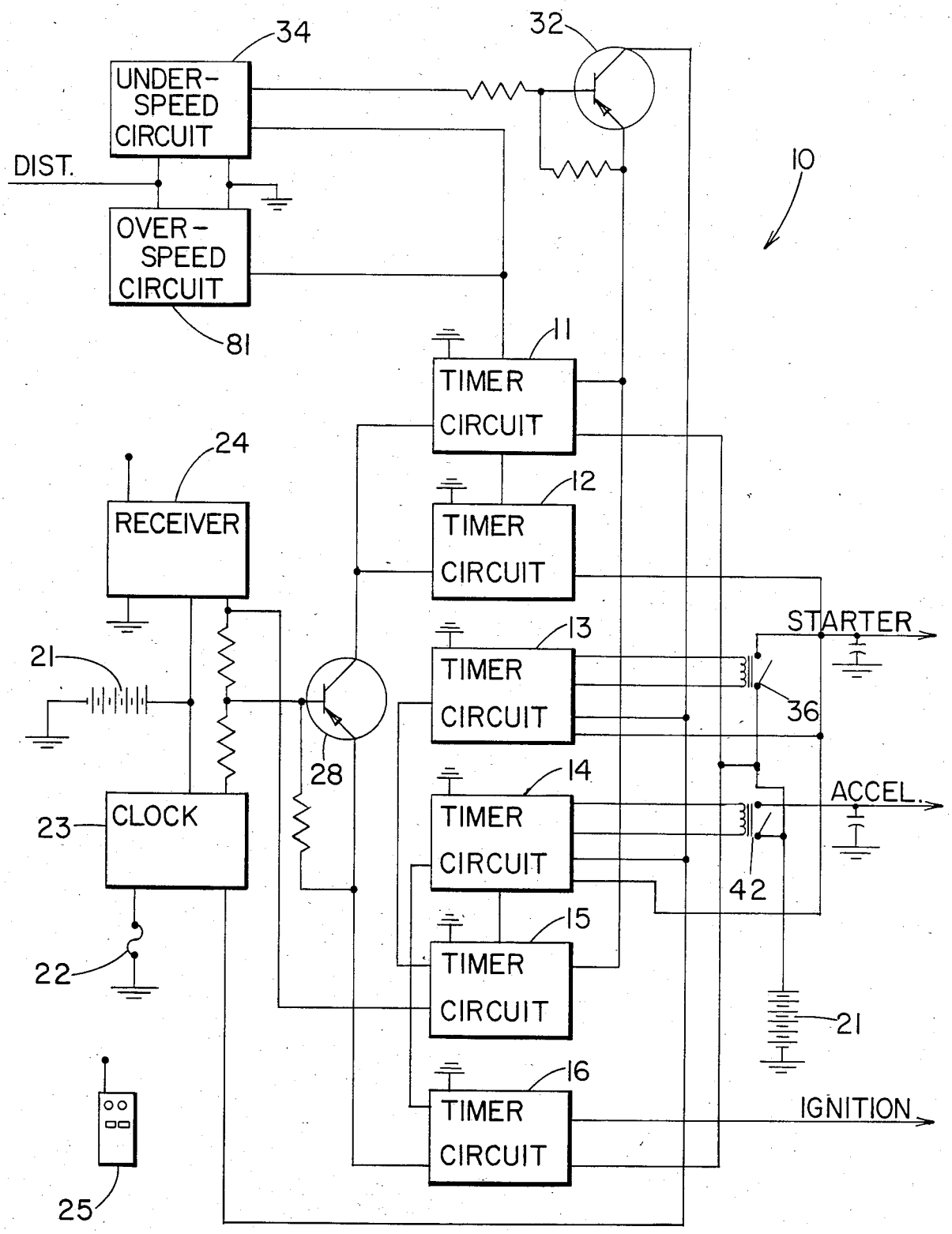
FIG. 1 is a block diagram illustration of an automatic vehicle starting system according to a typical embodiment of the present invention.
Figure 2:
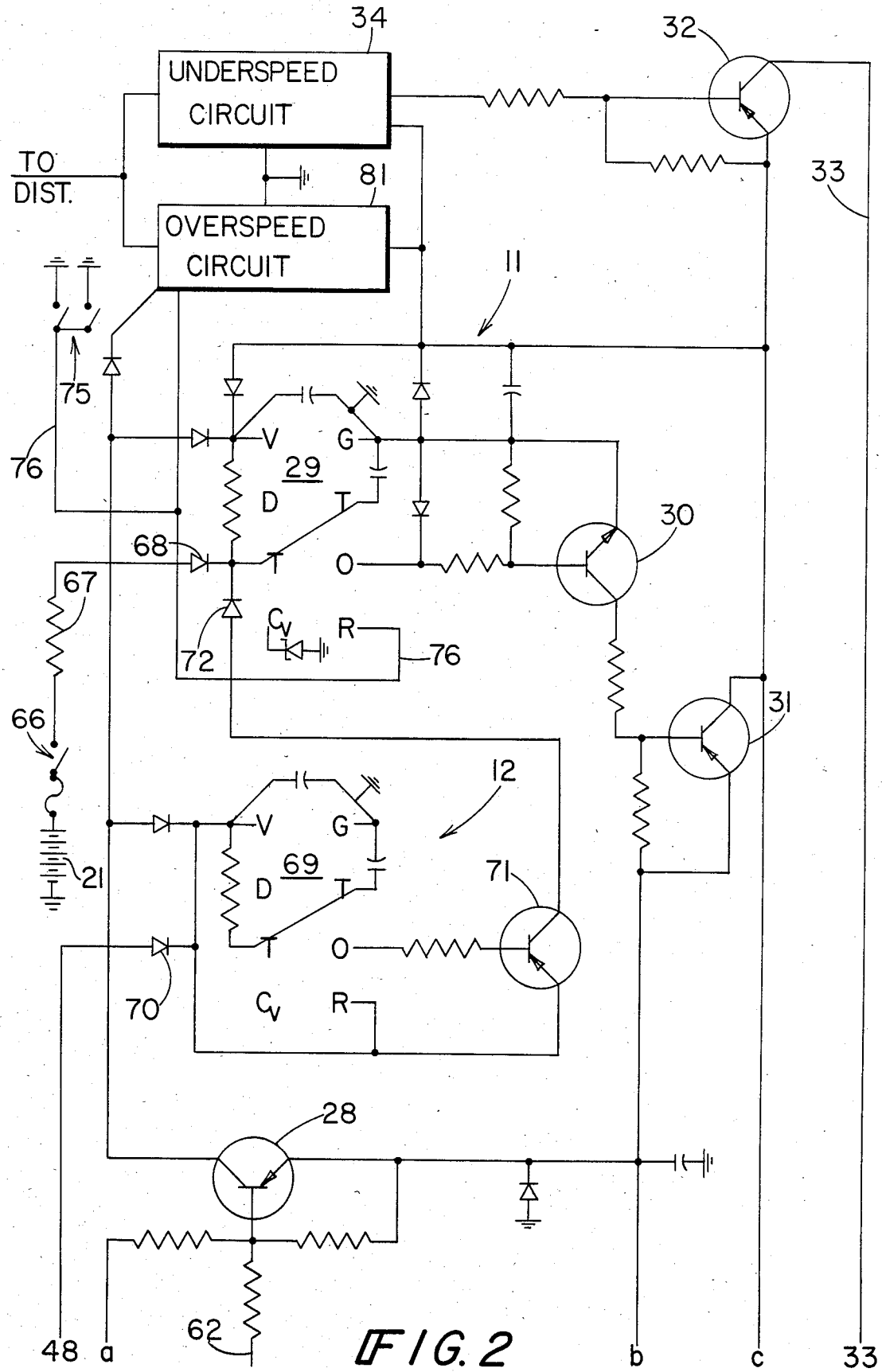
FIG. 2 is a detailed circuit illustration of one portion of the FIG. 1 block diagram.
Figure 3:
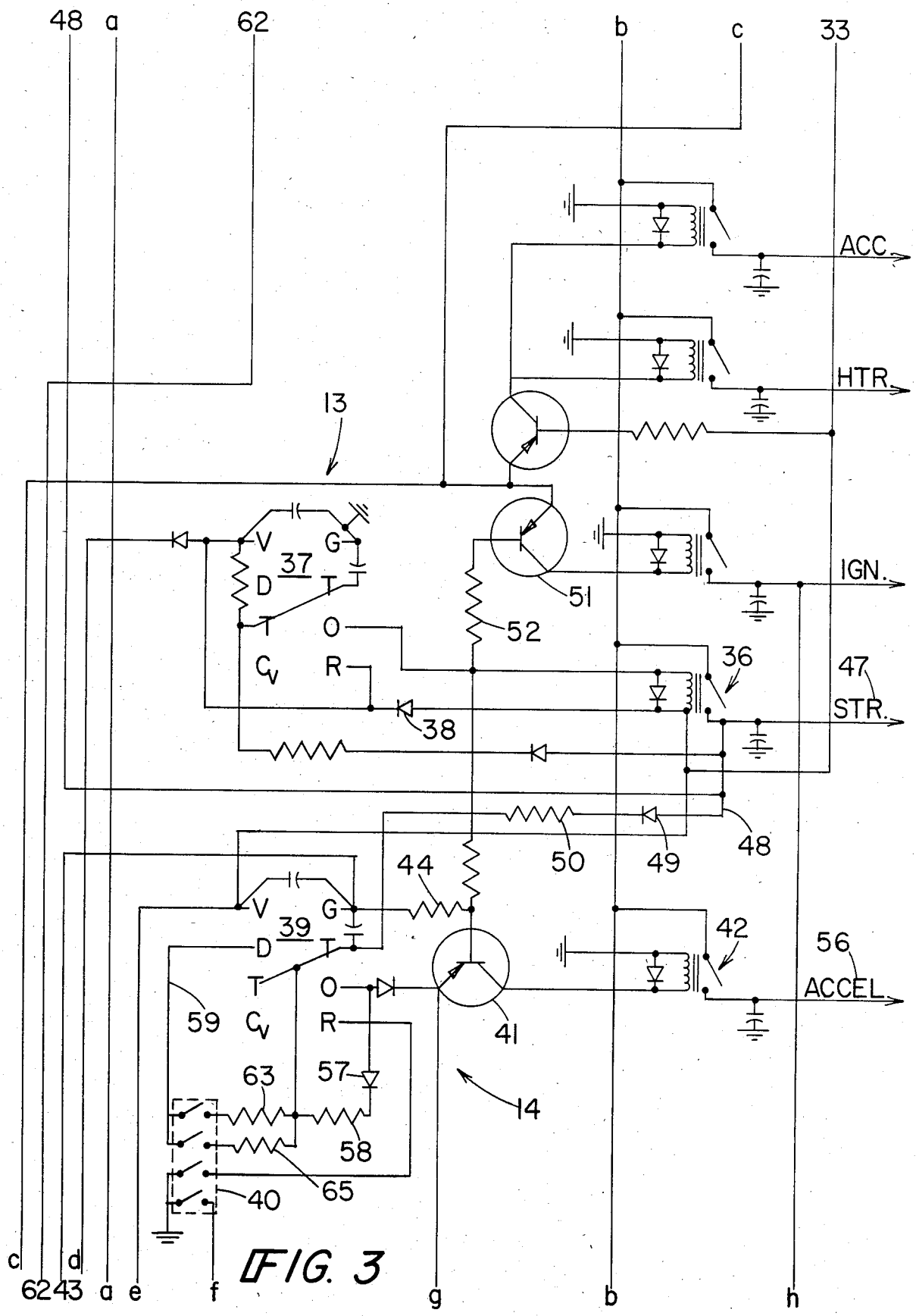
FIG. 3 is a detailed circuit illustration of one portion of the FIG. 1 block diagram.
Figure 4:
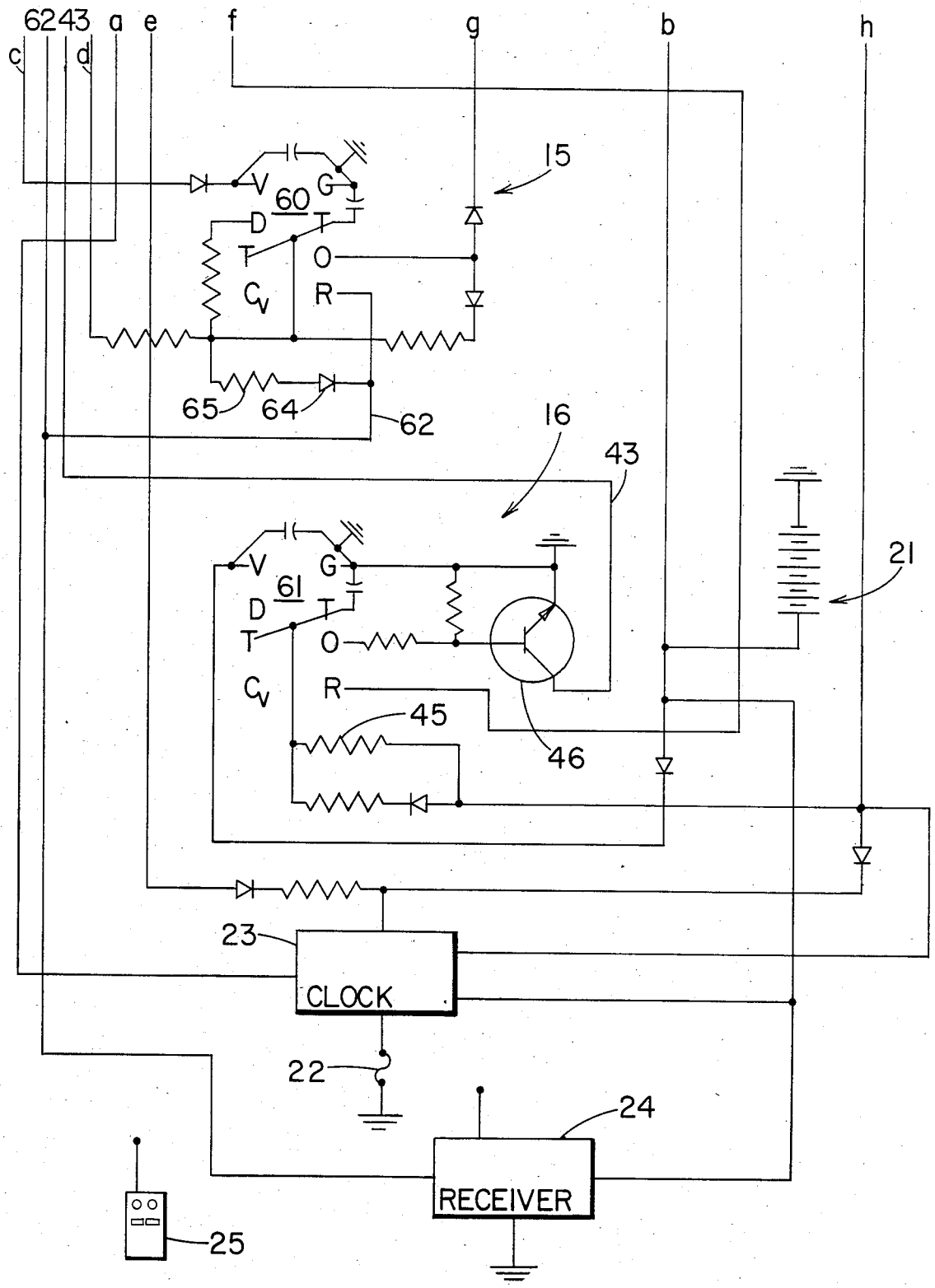
FIG. 4 is a detailed circuit illustration of one portion of the FIG. 1 block diagram.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated in diagrammatic and block diagram form automatic starting system 10 which is designed for the preselected timed starting as well as the remote starting of the internal combustion engine of a vehicle, such as for example an automobile. While every component and circuit connection is not illustrated in this diagrammatic block diagram, the main elements and functional blocks are disclosed. The circuitry of system 10 which is disclosed in greater detail by FIGS. 2–5, is energized by either clock 23 or receiver 24. The methods of activation of system 10 are described hereinafter, but for now an overview of the operation is included. The starting procedure differs according to the make and model of vehicle, as well as whether the engine is warm or cold. The nature of the engine is taken into consideration in determining how many, if any, gas pedal pumps there are to be, and when these are to occur.

After either the clock or receiver are activated, the first timer circuit 11 begins operation and assuming that it has received the proper signals and inputs, it controls the overall operational time of the system which is between 12 and 14 minutes as determined by a resistor and capacitor pair. During this time period, the timer within circuit 11 goes high and remains high unless one of the various warnings or safeguards cause interruption. For example, a brake pedal switch is present in system 10 and if activated by depressing the brake pedal, the timer in circuit 11 times out immediately.

One purpose of timer circuit 12 is to limit the starter cranking time to approximately 7 seconds, and thereafter time out the timer portion of circuit 11. With power supplied to circuit 12, its timer portion has an output which is high and by way of connecting transistor 71 keeps power off of the threshold of the timer of circuit 11. When the circuit 12 timer times out, the transistor becomes conductive sending power to the threshold of the circuit 11 timer.

Timer circuit 13 provides a delay before engaging the starter relay in order to provide a time period during which gas pedal pumping action may occur if selected for the particular vehicle. Another reason for the delay period is due to the possibility of the engine dying. This delay period assures that the engine has completely stopped running before the starter is allowed to reengage. When the timer of circuit 13 times out, its output goes low and turns on (activates) the starter relay and engages the starter.

Timer circuit 14 provides a means of either pumping the gas pedal prior to cranking, if pumping is needed, or to bypass this phase of the operation and simply depress the pedal while cranking. The choice depends upon the conditions existing within timer circuit 16. A power signal as well as a ground signal are required in order to generates gas pedal pumping prior to cranking. The necessary ground is either provided or not provided, depending upon the condition of a transistor within circuit 16. If provided, the timer of circuit 14 cycles on and off at a predetermined rate depending upon the number of pump depressions selected. If the ground signal is not present, the timer of circuit 13 will time out at which the point starter engages and power is supplied to relay 42 allowing the gas pedal to be depressed while cranking.

Timer circuit 15 provides a means for generating, either manually and/or automatically, a fast idle release by way of relay 42. The timer portion of circuit 15 recycles every two minutes (approximately) and each cycle momentarily operates relay 42 for creation of a one-half second or so depression of the gas pedal which action is the means to reduce the fast idle of the engine.

One purpose for the presence of timer circuit 16 is to provide a simulated engine temperature condition. As has been disclosed, there are reasons why attempts to sense engine temperature may prove unreliable or misleading. Consequently, the time period of engine operation relative to the engine being on or off are used as factors in order to control the timer of circuit 12 so that pumping of the gas pedal will only occur when it is required and then only to the degree and in the manner which is prescribed for the particular vehicle to which system 10 is installed. Circuit 16 includes a resistor through which the ground that is present from the ignition circuit when it is off bleeds back through in order to establish the requisite ground for the output of the timer within circuit 16 to go high. It is assumed in the design of the present system that after approximately two hours of the engine not running, it will be sufficiently cooled to require additional pumping action when it is restarted. If the engine is attempted to be restarted after it has been stopped for less than two hours, the engine is considered warm and a different pumping procedure is required.

Referring now to FIGS. 2–5, vehicle starting power is supplied by the vehicle battery 21 which also provides the requisite power to automatic starting system 10. The battery is coupled to a settable clock 23 which is in parallel with a remote control receiver 24. Ground is connected to clock 23 via fuse 22. Receiver 24 is responsive to signals from transmitter 25 in order to generate the necessary output signal for activation of the system as will be described hereinafter. Alternatively, clock 23 may be set to the desired time of day and when that time is reached, the vehicle will be automatically started as will be described hereinafter. It is also to be anticipated that starting system 10 may be provided with either receiver 24 or clock 23 or both.

As was previously discussed in the background discussion regarding the present invention, the present invention operates on a time basis rather than temperature basis depending upon how long the engine of the vehicle has been running or how long it has been standing idle, not running. Beginning with what will be considered normal conditions, assume that the vehicle engine has not been started or running for the past 2 to 2½ hours. In order to begin the procedure of remote starting of the vehicle engine, the user needs to press the acitivation button on the transmitter 25 for 1 or 2 seconds and thereafter release the button. As has previously been indicated, clock 23 could be preset to an exact time to start the vehicle engine, and either of these approaches are effective to activate transistor 28 (see FIGS. 2–5) which in turn sends power to timer 29. Timer 29 and its immediately surrounding circuitry are included as part of timer circuit 11. In fact, each timer circuit includes a different timer and corresponding surrounding circuitry. Circuit 12 includes timer 69, circuit 13 includes timer 37, circuit 14 includes timer 39, circuit 15 includes timer 60, and circuit 16 includes timer 61. The transmitter signal is decoded and processed by the receiver which sends a ground signal to transistor 28 causing the transistor to turn on and thereby providing power to the V+ terminal of timer 29. When the transmitter button is released, transistor 28 turns off, but timer 29 remains latched. The positive (high) output of timer 29 turns on transistors 30 and 31. Transistors 30 and 31 provide a latch-up circuit that lasts for a preselected period of time, which in the exemplary embodiment is approximately 12–14 minutes. Transistor 31 supplies controlled battery current to the balance of the system.

Once this occurs, the underspeed circuit section 34 which is a frequency-to-voltage converting circuit section receives power via transistor 31 and in turn senses that the engine is not running. This determination is made due to the fact that no input pulses from the distributor are present, and as a result underspeed circuit section 34 causes the activation or turns on transistor 32 sending power along circuit line 33, which line couples to relay 36, timer 37, diode 38 and timer 39. Circuit line 33 and the four circuit components previously mentioned constitute an underspeed delay circuit, all components of which get power at substantially the same time. The outputs of both timers 37 and 39 are high since relay 36 is not chassis grounded. Consequently, relay 36 will not operate until timer 37 times out. During this delay period for timer 37, timer 39 and both V+ and ground applied causing the timer to operate in a cyclic fashion switching between on and off status at a certain rate. This particular rate is selected by the gas pedal selector switch 40. Either 0, 1, 2 or 3 pumping activations can be selected as well as a warm or cold start mode or any sequence of pedal operations. It should be understood that the output of timer 39 which is a positive (high) voltage signal feeds into the input side of transistor 41, as illustrated. Once this transistor is turned on it supplies the engage voltage to relay 42. When timer 39 has a ground line 43, then resistor 44 turns on transistor 41.

A ground signal can be provided by timer 61 under proper circumstances. Assuming that the ignition switch has been off for at least two hours, the ground present from the ignition circuit will have had time to bleed back through resistor 45. With the ground present, the output of timer 61 goes high turning on transistor 46 which sends a ground along line 43 to timer 39 and resistor 44. With the underspeed circuit 34 activated, power is provided to the V+ terminal of timer 39 which switches high turning on transistor 41 which sends power to relay 42 resulting in activation of actuator 56. Actuator 56 is coupled to the gas pedal (throttle) linkage causing the gas pedal to be depressed for approximately 1.7 seconds. Actuator 56 is arranged with a vacuum pump and it is this combination which provides the gas pedal pumping action as generated by system 10. The output of timer 39 is connected by way of diode 57 and resistor 58 to the threshold of timer 39. Timer 39cycles between $+\frac{1}{3}$ V and $+\frac{2}{3}$ V in an astable condition. When the threshold is charged to $+\frac{2}{3}$ V, the output goes low (times out) placing a ground signal on line 59 which ground signal bleeds through either resistor 63 or 65 depending upon the switch position of selector switch 40, causing the threshold to begin discharging. During this discharge phase, the gas pedal is not depressed. The duration of this discharge phase is approximately 1.7 seconds if three pumping actions have been selected, and if only two pumping actions have been selected, the time is somewhat longer, in the range of 2.5–3.0 seconds.

Assuming that we have selected the desired number of gas pedal pumps of the gas pedal circuit, these gas pedal pumps occur during the time delay of timer 37. After timer 37 times out, a period of time equal to approximately 7 seconds in the exemplary embodiment, the starter relay is engaged sending power to the park-neutral switch 47. Similarly, starter current line 48 sends power by way of diode 49 and resistor 50 to the threshold of timer 39. This immediately times out timer 39 and thereby prevents the continued pedal pumping during the period of time that there is cranking of the vehicle engine. It is also of interest to note that transistor 51 has its base connected to the output of timer 37. Transistor 51 which is a PNP transistor supplies power for the ignition relay, noting that during the delay period this transistor was in an off condition. When the output of timer 37 goes low, it turns on transistor 51 by way of resistor 52 which in turn turns on the ignition relay supplying power to the ignition circuit while cranking. After engine starting, timer 37 remains low enough to keep transistor 51 turned on even though there is no power to the V+ terminal of timer 37. Should the engine die, power will be recycled to the V+ terminal of timer 37 and the output will go high. This in turn will turn off transistor 51 and the ignition and thereby create a new time delay. If the engine was not running very long, in the exemplary embodiment less than 22 seconds, timer 39 will repump the gas pedal and timer 37 will again time out and restart the engine. Now that the engine is cranking, pulses from the distributor or diesel means are activating the underspeed frequency circuit section 34 and when enough pulses are present, the underspeed frequency circuit section turns off the ground signal to transistor 32 by way of resistor 59 thereby removing power from timer 37 by way of diode 38, timer 39 and relay 36. Once this power is removed, the vehicle engine is in what is considered to be a normal run mode with timers 29 and 60 having power. Timer 61 is connected to the battery positive voltage at all times (to retain its memory).

After starting the cold engine, it is usually running on a fast idle which helps to warm up the engine quicker, but this fast idle clearly can waste gasoline if the idle is not reduced as soon as possible after the engine is adequately warmed. Timer 60 operates in an "astable mode." That is, it will come on (output high) for about $\frac{1}{2}$ to $\frac{3}{4}$ seconds and thereafter off for approximately 2 minutes. Consequently, every couple minutes, the timer cycles on and off sending power to relay 42 thereby giving a tap on the gas pedal to reduce this fast idle down to a normal and slower idle speed saving gas and reducing engine wear. Another feature of timer 60 is that it can create a manual fast idle command. When the transmitter button is depressed, the receiver also sends a ground signal along line 62 in addition to sending it to resistor 63. This ground signal discharges the threshold of timer 60 by way of diode 64 and resistor 65. This ground signal lowers the threshold and holds the reset low turning off timer 60. When the transmitter is released, so is the ground signal and this action recycles the timer, on command from the transmitter.

The starter system can be turned off by depressing the brake pedal of the automobile causing the brake pedal switch 66 to send a plus voltage from the battery to resistor 67, diode 68 and the threshold of timer 29 causing timer 29 to turn off. The starter system can also be turned off by remote control. By holding the transmitter button down continuously for approximately 7 seconds or more, its transmission activates transistor 28 sending power to timer 69. Timer 69 is responsive to transistor 28 or the starter circuit by way of diode 70. Timer 69 and transistor 71 receive power at the same time. While the transmitter button is depressed, transistor 28 sends power to timer 69 and transistor 71. After approximately 7 seconds, the timer times out (output low) and turns on transistor 71 and sends power to the threshold of timer 29 by way of diode 72 and results in turning off timer 29. If during the cranking stage, the vehicle engine fails to start after cranking approximately 6½ to 7 seconds, timer 69 also times out by way of diode 70 and this times out timer 29 as well. If during the normal run time of approximately 12–14 minutes, which is the capacity of timer 29, should the engine overheat, for any one of various reasons, overheat temperature switch 75 which is mounted on the radiator hose will sense the overheated condition and send a ground signal along line 76 to the reset pin of timer 29 causing the timer to turn off and preventing further damage to the engine. Alternatively, switch 75 can be mounted on the heater hose or against the block.

When the engine is assumed to be warm or not needing gas pedal pumping is a fact which is determined by timer 61 and resistor 45. Since timer 39 is not grounded, its output will remain at a high level sending continuous power to the input of transistor 41; however, transistor 41 is off during the delay period of timer 37. When timer 37 times out, it will turn on transistor 41 thereby depressing the gas pedal while the starter is engaged. The gas pedal will remain depressed during the starter cranking time and will be released when the engine starts. This particular starting procedure is recommended by most late model vehicle owner manuals, and the automatic starting system 10 was specifically designed to accomplish this recommended procedure as closely as possible.

As indicated, system 10 is provided with a selector switch 40 which offers one means to tailor the system to a particular style of vehicle. This switch permits selection of one of various number of pumping actions (gas pedal depressions) or warm or cold start mode or any combination of pedal operations. While a switch is disclosed, the tailoring of the system to a particular vehicle style could be done equally well with a hard-wire connection. The use of a switch could enable an easy operator conversion with the system remaining on the same vehicle. Alternatively, the use of a switch allows a fixed wiring procedure for the initial assembly with the appropriate switch position being selected thereafter. A hard-wired connection avoids the additional expense of a selector switch, but either approach enables the tailoring of the system to the particular vehicle. If the system is to be removed from one vehicle, it may be assembled to another with either approach being followed, simply selecting the appropriate wire connection or switch position to tailor the system to the new vehicle on which it is installed.

Figure 5:
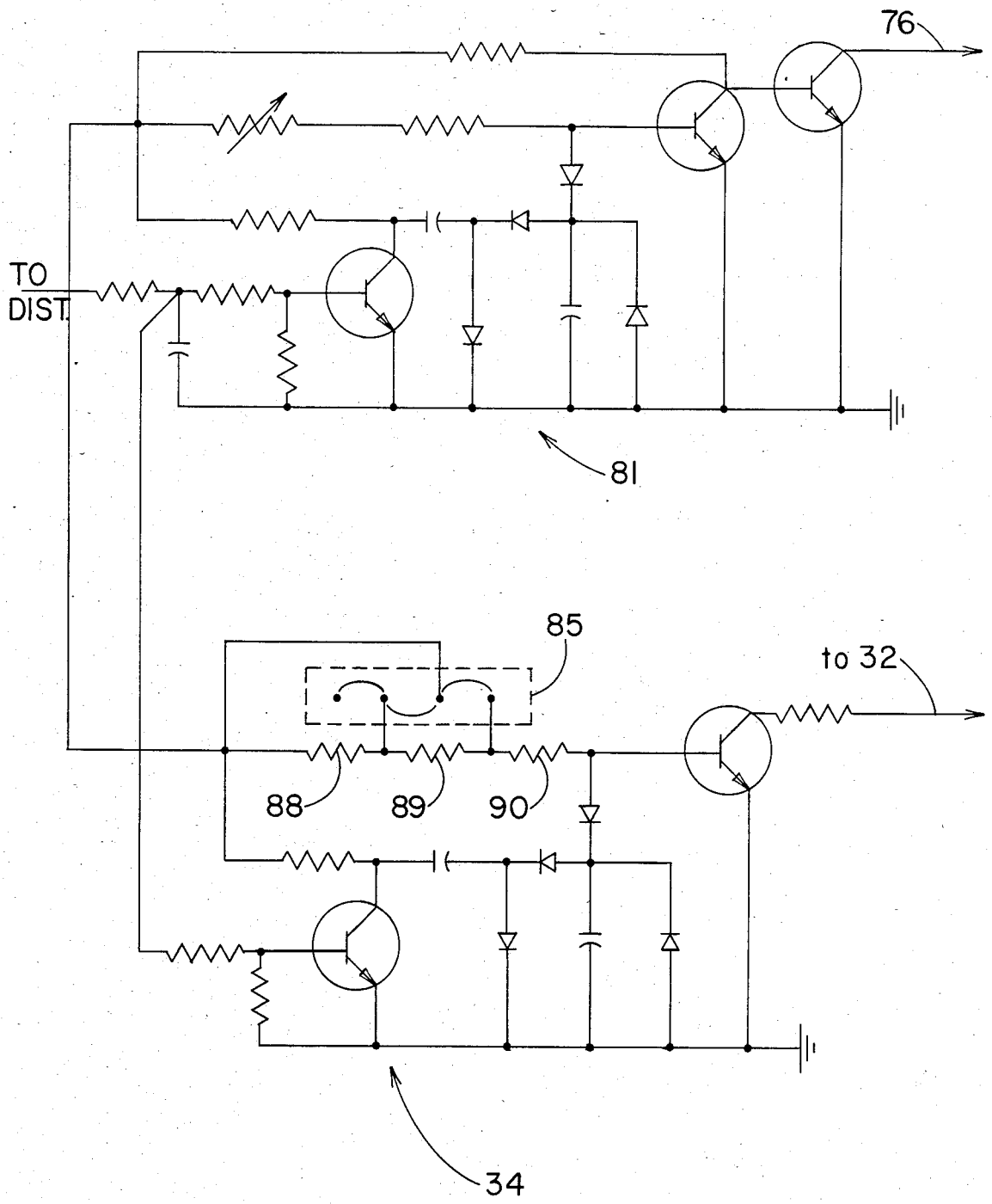
FIG. 5 is a detailed circuit illustration of one portion of the FIG. 1 block diagram.

Referring to FIG. 5, underspeed circuit 34 and overspeed circuit 81 are illustrated in greater detail. While the actual style of circuits for these two functional blocks may vary, and variations are believed to be well known in the art, the detailed circuitry is provided so that the operation of selector switch 85 can be better illustrated. Selector switch 85 is a dip switch that is settable to one of four positions. These four positions correspond to either a four-cylinder, six-cylinder, or eight-cylinder or diesel engine which correspond to the majority of present-day vehicles. Switch 85 provides yet another means of individually tailoring the system for the type of vehicle on which the system is installed. Again, while a dip switch is used, the choice as to the number of cylinders could be made by hard-wiring the switch contacts to their proper locations within the resistor series at the time the system is installed. This series of resistors includes resistors 88, 89 and 90, and the varying ohm values, depending on the point of connection, tailor this portion of the system circuitry to the number of cylinders present in the engine.

Should someone raise the hood during or before the system is activated, a ground signal is established on line 76 which couples to the reset pin of the timer 29 turning the timer off and thereby preventing bodily harm. Should the engine become over-revved, the system has an overspeed frequency circuit section 81 that is connected to the distributor or diesel means of the engine and if too many pulses are present over a particular time duration, the frequency circuit section establishes a ground signal on line 76 which is coupled to the reset pin of timer 29 and the presence of this ground signal turns off the timer and thereby prevent damage to the engine.

The system can also be turned off and kept off indefinitely by a dashboard switch or similar disconnect means. This switch is connected to chassis ground and when closed it supplies the necessary ground signal for the starter system. With the switch open, the starter system is immune to signals from the remote control transmitter or the clock. This switch is normally closed, but is used if a defect should occur and it should be used while working on the vehicle to prevent inadvertent start-ups.

Underspeed delay circuit section 34 supplies power for relay 36 as well as to timer 37 by way of diode 38. Since relay 36 does not have a ground signal, it cannot function and when timer 37 is turned on, its output is high and this is connected to the low terminal of the relay and the relay remains off until timer 37 times out and the output goes low. When this happens, relay 36 engages, supplying starter current to the park-neutral switch 47. Relay 36 is not chassis grounded and it needs a ground in order to operate properly. It receives this ground signal in order to operate when timer 37 times out approximately 7 seconds after power is applied by way of diode 38. Power is supplied from underspeed delay circuit section 34 for relay 36 and to timer 37.

One facet of the present invention is a means for bypassing a portion of the energizing/deenergizing means when the engine temperature of the vehicle is above a predetermined level. This predetermined engine temperature level is established by the amount of time the engine has been turned off rather than using a temperature switch. One reason for this approach is that during extremely cold weather, an external temperature switch will cool down prematurely due to the outside chill factor and will not properly reflect the actual internal engine temperature. The result is a false signal to the pedal pumping circuit which causes the gas pedal to be pumped as if the system was being properly triggered. This could result in flooding the engine. Therefore, the use of time in determining the gas pedal pumping is considered not only a more accurate means but a more reliable means, depending on the weather conditions. The normal time is approximately 2 hours after the ignition is off before the gas pedal would be permitted to be pumped by the presently designed circuitry. This approach allows for a normal cool-down of the engine.

As previously disclosed, the distributor is commonly connected to both the underspeed circuit block as well as the overspeed circuit block, and while this is the normal approach for conventional vehicles, a slight modification is required in the event the system is installed on a diesel engine. Under diesel circumstances, the distributor connection is replaced with diesel means and upon a start signal from the clock or receiver, the system switches to the run mode bypassing the underspeed circuit section for approximately a ¼ to 1-second duration. During this time period (run mode) the ignition and accessory relays are engaged causing the glow plugs to be heated if necessary. If the signal from the vehicle glow plug circuit to the wait light is present, the system will remain in the run mode until such signal disappears approximately 2–20 seconds, or as determined by the vehicle glow plug circuitry. Upon losing this signal or if no signal was initially present, the system will revert back to the normal start-up procedure as preprogrammed according to selector switch 40. It is envisioned that a pick-up coil will be installed on the engine in such a manner so as to detect engine RPM's. This pick-up coil substitutes for the distributor of the engine and sends pulses to the various frequency-to-voltage conversion circuits (underspeed circuit and overspeed circuits) in order to allow the necessary decision functions to be made.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An automatic starting system for a vehicle which includes a starter circuit, a battery and an internal combustion engine with a throttle-gas pedal linkage, said starting system comprising:

system energizing means electrically connectable to the battery of said vehicle, said system energizing means being selectively actuatable for conducting a current signal from said battery;

a plurality of switch means designed and arranged and electrically operable to couple said current signal from said system energizing means to the starter circuit of said vehicle;

gas pedal pumping means connectable to the throttle-gas pedal linkage of said vehicle; and means for alternatively energizing and deenergizing said gas pedal pumping means for a finite time interval thereby creating a pumping action of said throttle-gas pedal linkage, said energizing and deenergizing means including a plurality of electrical timers with different time-on intervals, means for initiating a variable number of time-on intervals of one timer within the time-on interval of a second connected timer, and means for supplying an output signal from said second timer to said one timer to disable further initiation of time-on intervals of said one timer when said second timer times out.

2. The automatic starting system of claim 1 wherein the time-on interval of said second connected timer is approximately 7 seconds and the time-on interval of said one timer is approximately 1.7 seconds.

3. The automatic starting system of claim 1 which further includes remote-controlled transmitter means having circuitry of a design compatible with said system energizing means for actuation of said system energizing means, said transmitter means circuitry and said system energizing means being arranged such that said transmitter means is operable to turn off said system.

4. The automatic starting system of claim 1 which further includes timing means for generating fast idle commands, such commands occurring once every predetermined time interval and being operable to cause one pump of said throttle-gas pedal linkage.

5. The automatic starting system of claim 1 which further includes hood safety switch means mechanically cooperating with opening of the vehicle hood and electrically adapted to remove battery current from said vehicle engine.

6. The automatic starting system of claim 1 which further includes brake pedal switch means mechanically cooperating with depression of the brake pedal and electrically adapted to remove battery current from said vehicle engine.

7. The automatic starting system of claim 1 wherein said initiating means includes means for varying the number of time-on intervals of said one timer by varying the time-off interval of said one timer.

8. The automatic starting system of claim 1 wherein said one timer and said second connected timer each include a solid-state device.

9. The automatic starting system of claim 1 wherein said one timer and said second connected timer each include an integrated-circuit timer having a threshold input, and wherein said means for supplying an output signal is operative to reset said one timer through its threshold input when said second connected timer times out.

10. The automatic starting system of claim 9 wherein said integrated-circuit timer in said one timer further includes a discharge output, a trigger input, and means for resistively coupling said discharge output to said trigger input, and wherein said initiating means includes means for varying the number of time-on intervals of said one timer by varying the time-off interval of said one timer, said varying means including means for varying the resistance between said discharge output and said trigger input.

11. An automatic starting system for a vehicle which includes a starter circuit, a battery and an internal combustion engine with a throttle-gas pedal linkage, said startng system comprising:

system energizing means electrically connectable to the battery of said vehicle, said system energizing means being selectively actuatable for conducting a current signal from said battery;

a plurality of timer circuits arranged to cycle between high and low signal outputs according to their time-out intervals, said timer circuits being arranged and electrically operable to couple said current signal from said system energizing means to the starter circuit of said vehicle;

gas pedal pumping means connectable to the throttle-gas pedal linkage of said vehicle; and means for alternatively energizing and deenergizing said gas pedal pumping means for a finite time interval thereby creating a pumping action of said throttle-gas pedal linkage, said energizing and deenergizing means including a plurality of electrical timers with different time-on intervals, means for initiating a variable number of time-on intervals of one of said plurality of timers within the time-on interval of a second connected timer, and means for supplying an output signal from said second timer to said one timer to disable further initiation of time-on intervals of said one timer when said second timer times out.

12. The automatic starting system of claim 11 wherein said one of said plurality of timers controls the duration of each pump of said linkage.

13. The automatic starting system of claim 12 wherein said second connected timer controls the time interval during which said one of said timers operates.

14. The automatic starting system of claim 11 wherein said plurality of timer circuits includes six separate timer circuits, each including therein corresponding timers.

15. The automatic starting system of claim 11 which further includes means for generating fast idle commands, such commands occurring once every predetermined time interval and being operable to cause one pump of said throttle-gas pedal linkage.

16. The automatic starting system of claim 11 which further includes hood safety switch means mechanically cooperating with opening of the vehicle hood and electrically adapted to remove battery current from said vehicle engine.

17. The automatic starting system of claim 11 which further includes brake pedal switch means mechanically cooperating with depression of the brake pedal and electrically adapted to remove battery current from said vehicle engine.

18. An automatic starting system for a vehicle which includes a starter circuit, a battery and an internal combustion engine with a throttle-gas pedal linkage, said starting system comprising:

system energizing means electrically connectable to the battery of said vehicle, said system energizing means being selectively actuatable for conducting a current signal from said battery;

a plurality of switch means designed and arranged and electrically operable to couple said current signal from said system energizing means to the starter circuit of said vehicle;

gas pedal pumping means connectable to the throttle-gas pedal linkage of said vehicle; and means for alternately energizing said deenergizing said gas pedal pumping means, said energizing and deenergizing means including a plurality of timers, one of said timers being responsive to the time interval said vehicle engine has been off, said energizing and deenergizing means including means responsive to said one of said timers for bypassing another of said timers when the engine has been off less than a predetermined length of time.

19. The automatic starting system of claim 18 wherein the predetermined length of time said engine has been off is approximately two hours.

20. The automatic starting system of claim 18 which further includes remote-controlled transmitter means having circuitry of a design compatible with said system energizing means for actuation of said system energizing means, said transmitter means circuitry and said system energizing means being arranged such that said transmitter means is operable to turn off said system.

21. The automatic starting system of claim 18 which further includes timing means for generating fast idle commands, such commands occurring once during every predetermined time interval and being operable to cause one pump of said throttle-gas pedal linkage.

22. The automatic starting system of claim 18 which further includes hood safety switch means mechanically cooperating with opening of the vehicle hood and electrically adapted to remove battery current from said vehicle engine.

23. The automatic starting system of claim 18 which further includes brake pedal switch means mechanically cooperating with depression of the brake pedal and electrically adapted to remove battery current from said vehicle engine.

24. A remote-controlled starting system for a vehicle which has a starter circuit, a battery, and a throttle-gas pedal linkage, said starting system comprising:

receiver means disposed between said battery and the balance of said system for conducting a current signal from said battery when activated;

a plurality of timer circuits interconnected to one another and operable to control the energizing of said starter circuit;

actuator means for generating a pumping action of said throttle-gas pedal linkage; and tailoring means for selectively varying the electrical characteristics of said starting system according to the type of vehicle to which said system is connected, said tailoring means including electronic timer means for selectively varying the number of pumping actions generated by said actuator means, said timer means including first and second interconnected timers, means for varying the number of time-on intervals of said first timer, and means responsive to an output signal from said second-timer for disabling said first timer when said second timer times out.

25. The remote-controlled starting system of claim 24 wherein a first one of said plurality of timer circuits controls the duration of each pump of said linkage.

26. The remote-controlled starting system of claim 25 wherein a second one of said plurality of timer circuits controls the timer interval during which said first one of said plurality of timer circuits operates.

27. The remote-controlled starting system of claim 24 wherein said tailoring means includes a selector switch for selecting between a different number of throttle-gas pedal linkage pumps to occur during each starting cycle.

28. A remote-controlled starting system for a vehicle which has a starter circuit, a battery, and a throttle-gas pedal linkage, said starting system comprising:

receiver means disposed between said battery and the balance of said system for conducting a current signal from said battery when activated;

a plurality of timer circuits interconnected to one another and operable to control the energizing of said starter circuit;

actuator means for generating a pumping action of said throttle-gas pedal linkage; and tailoring means for selectively varying the electrical characteristics of said startng system according to the type of vehicle to which said system is connected, wherein said tailoring means includes a selector switch for selecting the number of vehicle cylinders which are present with the vehicle to which the starting system is installed.

29. The remote-controlled starting system of claim 28 wherein said tailoring means further includes a selector switch for selecting between a different number of throttle-gas pedal linkage pumps to occur during each starting cycle.

30. An automatic starting system for a vehicle which includes a starter circuit, a battery and an internal combustion engine with a throttle-gas pedal linkage, said starting system comprising:

system energizing means electrically connectable to the battery of said vehicle, said system energizing means being selectively actuatable for conducting a current signal from said battery;

a plurality of switch means designed and arranged and electrically operable to couple said current signal from said system energizing means to the starter circuit of said vehicle;

gas pedal pumping means connectable to the throttle-gas pedal linkage of said vehicle; and means for alternately energizing and deenergizing said gas pedal pumping means, said energizing and deenergizing means including inhibit means for inhibiting a portion of said energizing and deenergizing means when the engine has been off less than a predetermined length of time, said inhibit means including a timer responsive to the time interval said vehicle engine has been off.

31. The automatic starting system of claim 30 which further includes remote-controlled transmitter means having circuitry of a design compatible with said system energizing means for actuation of said system energizing means, said transmitter means circuitry and said system energizing means being arranged such that said transmitter means is operable to turn off said system.

32. The automatic starting system of claim 30 which further includes timing means for generating fast idle commands, such commands occurring once during every predetermined time interval and being operable to cause one pump of said throttle-gas pedal linkage.

33. The automatic starting system of claim 30 which further includes hood safety switch means mechanically cooperating with opening of the vehicle hood and electrically adapted to remove battery current from said vehicle engine.

34. The automatic starting system of claim 30 which further includes brake pedal switch means mechanically cooperating with depression of the brake pedal and electrically adapted to remove battery current from said vehicle engine.

35. The automatic starting system of claim 30 wherein the predetermined length of time said engine has been off is approximately two hours.

36. The automatic starting system of claim 35 which furthr includes remote-controlled transmitter means having circuitry of a design compatible with said system energizing means for actuation of said system energizing means, said transmitter means circuitry and said system energizing means being arranged such that said transmitter means is operable to turn off said system.

37. The automatic starting system of claim 36 which further includes timing means for generating fast idle commands, such commands occurring once during every predetermined time interval and being operable to cause one pump of said throttle-gas pedal linkage.

38. The automatic starting system of claim 37 which further includes hood safety switch means mechanically cooperating with opening of the vehicle hood and electrically adapted to remove battery current from said vehicle engine.

39. The automatic starting system of claim 38 which further includes brake pedal switch means mechanically cooperating with depression of the brake pedal and electrically adapted to remove battery current from said vehicle engine.

* * * * *